US009453331B1

(12) United States Patent
Buffington

(10) Patent No.: US 9,453,331 B1
(45) Date of Patent: Sep. 27, 2016

(54) LEVELING AND ELEVATION ADAPTER FOR THE GRATE OF A FLOOR DRAIN

(71) Applicant: Jason Buffington, Springfield, MO (US)

(72) Inventor: Jason Buffington, Springfield, MO (US)

( * ) Notice: Subject to any disclaimer, the term of this patent is extended or adjusted under 35 U.S.C. 154(b) by 218 days.

(21) Appl. No.: 14/054,118

(22) Filed: Oct. 15, 2013

Related U.S. Application Data

(63) Continuation-in-part of application No. 12/799,079, filed on Apr. 16, 2010, now abandoned.

(60) Provisional application No. 61/212,849, filed on Apr. 16, 2009.

(51) Int. Cl.
*E03F 5/04* (2006.01)

(52) U.S. Cl.
CPC ..... *E03F 5/041* (2013.01); *E03F 5/0407* (2013.01); *E03F 5/0409* (2013.01); *E03F 2005/0412* (2013.01); *E03F 2005/0413* (2013.01); *E03F 2005/0414* (2013.01)

(58) Field of Classification Search
CPC ..... E03F 5/04; E03F 5/0407; E03F 5/0409; E03F 2005/0412; E03F 2005/0413; E03F 2005/0414
See application file for complete search history.

(56) References Cited

U.S. PATENT DOCUMENTS

| | | | | |
|---|---|---|---|---|
| 1,766,621 | A | 6/1930 | Fleming | 210/165 |
| 1,779,936 | A | 10/1930 | Hess | 285/263 |
| 1,792,345 | A | 2/1931 | Williams | 210/164 |
| 2,121,984 | A | 6/1938 | Rieger et al. | 285/58 |
| 2,190,532 | A | 2/1940 | Lukomski | 210/164 |
| 2,490,075 | A | 12/1949 | Matheis | 210/165 |
| 2,672,205 | A | 3/1954 | McDonald | 285/42 |
| 2,699,555 | A | 1/1955 | Green | 4/288 |
| 2,783,852 | A | 3/1957 | Sisk | 210/165 |
| 2,859,452 | A | 11/1958 | Seewack | 210/165 |
| 3,246,582 | A | 4/1966 | Wade et al. | 210/165 |
| 3,285,289 | A | 11/1966 | Titus | 138/89 |
| 3,420,552 | A | 1/1969 | Mork | 285/42 |
| 3,774,765 | A | 11/1973 | Kane et al. | 210/164 |
| 4,067,072 | A | 1/1978 | Izzi | 4/288 |
| 4,092,745 | A | 6/1978 | Oropallo | 4/288 |
| 4,146,939 | A | 4/1979 | Izzi | 4/286 |
| 4,273,467 | A | 6/1981 | Cronk | 404/26 |
| 4,694,513 | A | 9/1987 | Kiziah | 4/288 |
| 4,823,411 | A | 4/1989 | Nettel | 4/265.1 |
| 4,871,451 | A | 10/1989 | Piskula | 210/164 |
| 4,879,771 | A | 11/1989 | Piskula | 4/191 |

(Continued)

OTHER PUBLICATIONS

Sioux Chief Manufacturing, Finish Line Brochure (2008), Peculiar, Missouri.

*Primary Examiner* — Kevin Murphy
(74) *Attorney, Agent, or Firm* — Jonathan A. Bay

(57) ABSTRACT

An adapter provides leveling and elevation adjustment between the grate and strainer head of a floor drain. The strainer head is cemented in hardened concrete and has an upper seat for removably accepting the grate. The strainer head also has a tubular body defining the tubular lumen that is the drain hole. The adapter for the grate has a base ring, a set ring and a plurality of jack screws. The base ring gets seated in the strainer head's seat. The set ring forms a replacement seat for the grate to seat. Jack screws threaded into inboard tabs of the base ring provide elevation adjustment to the overlying set ring. The jack screws are disposed relative the strainer head such that the tip end and lower exposed thread portions thereof occupy and travel in the tubular lumen of the strainer head.

19 Claims, 12 Drawing Sheets

(56) References Cited

U.S. PATENT DOCUMENTS

| | | | | |
|---|---|---|---|---|
| 4,883,590 | A | 11/1989 | Papp | 210/164 |
| 5,154,024 | A | 10/1992 | Noel | 52/12 |
| 6,076,559 | A * | 6/2000 | Castillo | E03F 5/04 138/89 |
| 6,179,518 | B1 | 1/2001 | Suatac | 404/26 |
| 6,269,495 | B1 | 8/2001 | Sondrup | 4/679 |
| 6,344,137 | B1 | 2/2002 | Chiang | 210/164 |
| 6,350,373 | B1 | 2/2002 | Sondrup | 210/164 |
| 6,381,775 | B1 | 5/2002 | Sondrup | 4/679 |
| 6,687,825 | B1 | 2/2004 | Challener et al. | 713/176 |
| 6,687,925 | B2 | 2/2004 | Minnick | 4/613 |
| 6,766,545 | B2 | 7/2004 | Hodges | 4/679 |
| 7,735,512 | B1 | 6/2010 | Ismert et al. | 137/362 |
| 7,964,095 | B1 | 6/2011 | Graybeal | 210/164 |
| 2008/0308476 | A1 | 12/2008 | Silverstein et al. | 210/163 |
| 2009/0223884 | A1 | 9/2009 | Wroblewski | 210/163 |

* cited by examiner

LEVELING AND ELEVATION ADAPTER FOR THE GRATE OF A FLOOR DRAIN

CROSS-REFERENCE TO PROVISIONAL APPLICATION(S)

This application is a continuation-in-part of U.S. patent application Ser. No. 12/799,079, filed Apr. 16, 2010, which claims the benefit of U.S. Provisional Application No. 61/212,849, filed Apr. 16, 2009, all of which the disclosures thereof are incorporated herein by this reference thereto.

BACKGROUND AND SUMMARY OF THE INVENTION

The invention relates to plumbing and, more particularly, to a leveling and elevation adapter for the grate of a floor drain. That is, the adaptor not only provides for leveling adjustment of the grate relative to the plane of the floor surface, but also elevation adjustment as well.

Floor drain construction has suffered from a longstanding problem that has existed for a long time, and, persists today. The problem is as follows. So often, the grate of a floor drain sits in its own shallow depression below the grade of the surrounding floor surface. That is, the grate of the floor drain may sit in a depression or recess that is a quarter inch to half inch (~6 to ~12 mm) deep below the grade of the floor surface. This shallow depression in the floor surface presents a trip hazard.

The inventor hereof is aware that, nowadays, there is heightened sensitivity to floor drains functioning as trip hazards. The parties who are now more sensitive to this issue of trip hazards includes not only managers of present day construction sites, but also, owners of aging commercial or institutional buildings as well. It is not known if this new sensitivity to trip hazards is driven by the American with Disabilities Act, or other current pressures, but the sensitivity seems more prevalent nowadays than in the past.

FIGS. 1 through 4 comprises a sequence of views showing how this problem develops during construction of a floor drain 105-108, both according to how construction is practiced today as well as how it has been practiced for over many many years previously. FIG. 1 shows a floor drain grate 108 making its appearance through a concrete slab 120 fresh after a pour. FIG. 2 is a sectional view taken along line II-II in FIG. 1, except showing an earlier time during the construction process, earlier than the time of FIG. 1. FIG. 3 is a view comparable to FIG. 1 except showing the result of the tile-workers having placed tile pieces 122 over the concrete slab 120 and prior to grouting the tile pieces together. FIG. 4 is a section view comparable to FIG. 2 except showing the state of things in FIG. 3.

The following description of this floor construction process entails the involvement of three different contractors (or trade skills):—plumbers, concrete workers, and tilers. At some original time, plumbers came through the construction site and laid all the plumbing for the drainwater piping 112 and floor 105-108 drains across the floor layout before the concrete slab 120 was ever poured. For a big commercial or institutional floor, there might be numerous drains 105-108 distributed in some array or some pattern as called out by the floor plan. As can be imagined by reference to FIG. 2, there would have been a distributed array of PVC risers 112 sticking up like so many small stumps across the floor layout, each crowned with a floor drain 105-108.

The floor drain 105-108 illustrated in the drawings is a product of the Jay R. Smith Mfg. Co. (founded in 1926 in New York City). However, it is believed both that the design particulars of this floor drain 105-108 are pretty similar to those of other manufacturers, and also that, the design particulars are (for the most part) irrelevant to the invention.

This floor drain 105-108 comprises a cast iron body 105, which is situated directly on top of the PVC riser 112, a cast iron reversible (ie., invertible) flashing collar 106 secured to the cast iron body 105 by three collar bolts 114 (only one shown), a strainer head 107 that threads into the flashing collar 106 by 3¾ inch 12 pitch thread, and, a grate 108 sitting in a seat 116 for it in the strainer head 107.

The inventor hereof has heard the combination of the body 105 and flashing collar 106 assembled together as the "sump" 105-106 or "sump assembly" 105-106.

Before the concrete pour, the plumbers make one last walk through the floor layout. Mainly, they check to see if the grates 108 are (a) in position, (b) level and (c) at the specified elevation. Many plumbers furthermore cover each grate 108 with duct tape 124 or the like to prevent wet concrete from seeping in. After that, all is ready for the concrete workers.

The concrete slab 120 is typically poured over the floor layout from cement mixer trucks or the like (not shown). The concrete pour progresses across the floor layout in a wave or series of waves. It is one of the jobs of the concrete workers to contain the momentum of those waves. That is, a concrete wave can easily gather enough momentum to barrel over the forms that are meant to dam it. However, a concrete wave with a whole lot less momentum than that can easily tilt the PVC riser 112 over to be a little crooked, and hence make the drain 105-108 uneven.

And once that tilt is introduced, there is little possibility of straightening out the PVC riser 112 in that matrix of the wet concrete. Hence the tilt, and unevenness, remain.

Moreover, some pour jobs are done where the concrete workers try to produce a little rise between drains 105-108, with a gentle downslope into the drains 105-108 (not shown). While that kind of concrete work is skillful business, it just aggravates the likelihood that the grate 108 will sit in the bottom of a depression that could likely become a trip hazard.

In any event, FIG. 2 shows the result of what so typically happens after the concrete slab 120 hardens. The floor drain 105-108 is a little tilted, with the grate 108 lying at an elevation a little below surface grade of the concrete slab 120. Indeed, concrete pour would have lapped over and onto the duct-tape 124 covered grate 108, and left the grate 108 with a thin covering of hardened concrete (not shown). Someone would have come back along afterwards (not necessarily the plumbers) and gently tapped out by hammer that thin covering of concrete (not shown). As result, there is sort of a ragged concrete rim 126 surrounding the grate 108.

To return to FIG. 2, it shows the following. Once the concrete slab 120 hardened, the following features are permanently cemented in place:—namely, the PVC riser 112, the cast iron body 105, the flashing collar 106, and the strainer head 107. Hence it is impossible to straighten the PVC riser 112 to become vertical again. Moreover, it also impossible to twist the strainer head 107 in or out of its threaded connection with the flashing collar 106. The wet concrete pour flowed into the exposed thread of the strainer head 107, and other exposed features of the flashing collar 106 and cast iron body 105. Once the concrete hardens, these features are rigidly cemented in place in the hardened concrete.

There is no adjustability after the concrete hardens. Also, there probably would be no practical opportunity to adjust the drains 105-108 while the concrete is wet and curing.

FIG. 1 shows the grate 108 peeking through the concrete slab 120, both after the thin covering (not shown) of hardened concrete has been tapped off the duct tape 124 and after the duct tape 124 has been peeled off. As FIG. 1 shows, the grate 108 sits in a mini depression in the concrete slab 120. The depth of this depression will be increased if the construction plans call for covering the concrete slab 120 with tile pieces 122 or the like.

And FIGS. 3 and 4 show exactly that. Adding tile pieces 122 around the grate 108 just increases the depth of the depression in the tile floor 128 down to the top of the grate 108. The potential trip hazard made to pedestrians across the tile floor 128 has just been made greater. The depression around the grate 108 has just simply been made deeper.

Pause can be taken now for applicant to remark on the following prior art disclosures.

U.S. Pat. No. 7,964,095—Graybeal discloses an adjustable floor drain. The Graybeal drain has a strainer head 20, a grate 40, and an interposed adjustment ring 30 which can be elevated relative to the strainer head 40 by elevating screws 31. See FIGS. 2 and 2*b* therein. The document recites in the last two paragraphs of the description (in part):

> The installation and use of the floor drain can now be considered. After the vertical pipe (with or without a separate fitting) are set in place, and before the concrete floor is poured, the flanged cylindrical body [20] (with or without the ring [30] and grate [40] in place) is connected to the pipe or fitting. The elevating screws [31] of the body are preferably screwed in (lowered) as far as possible initially. A disposable cover is put into place to prevent concrete from entering the interior of the floor drain. The concrete floor is then poured and finished.
>
> After the concrete floor has hardened, the disposable cover is removed. If not already in place, the ring [30] is then set in place on the flange [23] and the elevating screws [31] are adjusted by unscrewing (raising) them to make the top of the ring [30] perfectly flush with the surrounding floor. It can be appreciated that the adjustability range is increased as the length of the elevating screws [31] increases . . . .

With reference to FIG. 2*b* in Graybeal, the space below the horizontal flange 23 of the strainer head 20 is going to be filled with hardened concrete. Graybeal has pre-drilled and pre-tapped his holes 31 and 32 as a manufacturing step for strainer head 20 before the strainer head 20 is cemented into hardening concrete.

Drilling and tapping such holes cannot be done after the concrete pour has hardened. Accordingly, the design concept of Graybeal cannot be used to retro-fit existing floor drains in aging commercial or institutional buildings that do not have Graybeal-style pre-drilled and pre-tapped horizontal flanges 23 in strainer heads 20.

Moreover, Graybeal asserts in the above passage that, "It can be appreciated that the adjustability range is increased as the length of the elevating screws [31] increases." Applicant is skeptical about that assertion.

For the Graybeal design to work, there is the time before the concrete pour where Graybeal has to pre-install his elevating screws 31 into the horizontal flange 23 of the strainer head 20 such that "The elevating screws [31] of the body are preferably screwed in (lowered) as far as possible initially." In other words, Graybeal leaves the bottom ends of his elevating screws 31 (see FIG. 2*b* thereof) exposed to being encased in the matrix of the wet concrete. When the wet concrete hardens, the bottom ends of elevating screws 31 are going to be cemented solid into the hardened concrete.

It has been the inventor's experience that hardened concrete has, indeed, a highly secure grip on encased features. There is a question as to, how much grip length on (for example) a one-quarter inch normal screw thread can be cemented solid into hardened concrete before the screw can never be untwisted out without the thread being fouled, or the screw snapping apart.

It surely is unrealistic to hope that any appreciable length one-quarter inch normal screw thread can be cemented into hardened concrete and thereafter be untwisted out without irreparable scarring to the screw thread, or worse, without snapping the screw in two.

U.S. Pat. No. 4,883,590—Papp also discloses an adjustable floor drain. The Papp floor drain appears to be a proprietary design unique to Papp and not an insert to a standardized design typical of the industry and typical of major producers in the industry such as (and without limitation) the Jay R. Smith Mfg. Co.

The Papp design has a singular outer body 13 which combines the features and functions of the conventional cast iron body 105 and flashing collar 106 shown in FIGS. 2 and 4 hereof.

Conversely, the Papp design has a pair of components which provide the features and functions of the conventional strainer head 107 shown in FIGS. 2 and 4 hereof:—namely, an externally-threaded sleeve 15 (with a spherical ball-seat surface 20) and a ring 17 (with lower spherical ball surface 18) (albeit, the Papp sleeve 15 and ring 17 provide some additional functionality over a conventional strainer head 107, as described next in part).

The threading of the Papp cylindrical sleeve 15 into the Papp outer body 13 provides elevation adjustment. The gyroscopic leveling of the Papp ball-formed ring 17 into (the ball seat 20 of) the Papp sleeve 15 provides leveling adjustment. The whole premise for the Papp design to work depends on, again and like Graybeal, anticipating and nullifying the cementing effects of hardening concrete.

Like the conventional drain design of Jay R. Smith Mfg. Co. and others, Papp does pre-install and pour wet concrete around the his equivalent of the cast iron body (105) and flashing collar (106), eg., the Papp outer body 13. Unlike the conventional design of Jay R. Smith Mfg. Co. and others, Papp leaves removed his equivalent of the strainer head (107) (eg., the Papp sleeve and ring 15 and 17). Papp keeps wet concrete from pouring into his open outer body 13 by means of a cardboard cylindrical shield 25. The cardboard cylindrical shield 25 leaves a clear and free-of-concrete column above the internal thread of the outer body 13 into which the external thread of the sleeve 15 can be twisted into:—once the cardboard shield has been plucked out of the hardened concrete.

It surely is unrealistic to hope that any appreciable vertical length of cylindrical cardboard shield can be plucked out of hardened concrete. Regardless, the Papp design does not interface with nor allow the retro-fitting of existing drains on aging commercial or institutional buildings.

What is needed is an improvement which will overcome the shortcomings of the prior art.

A number of additional features and objects will be apparent in connection with the following discussion of the preferred embodiments and examples with reference to the drawings.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains. In the drawings.

DETAILED DESCRIPTION OF THE PREFERRED EMBODIMENTS

Figure 5:
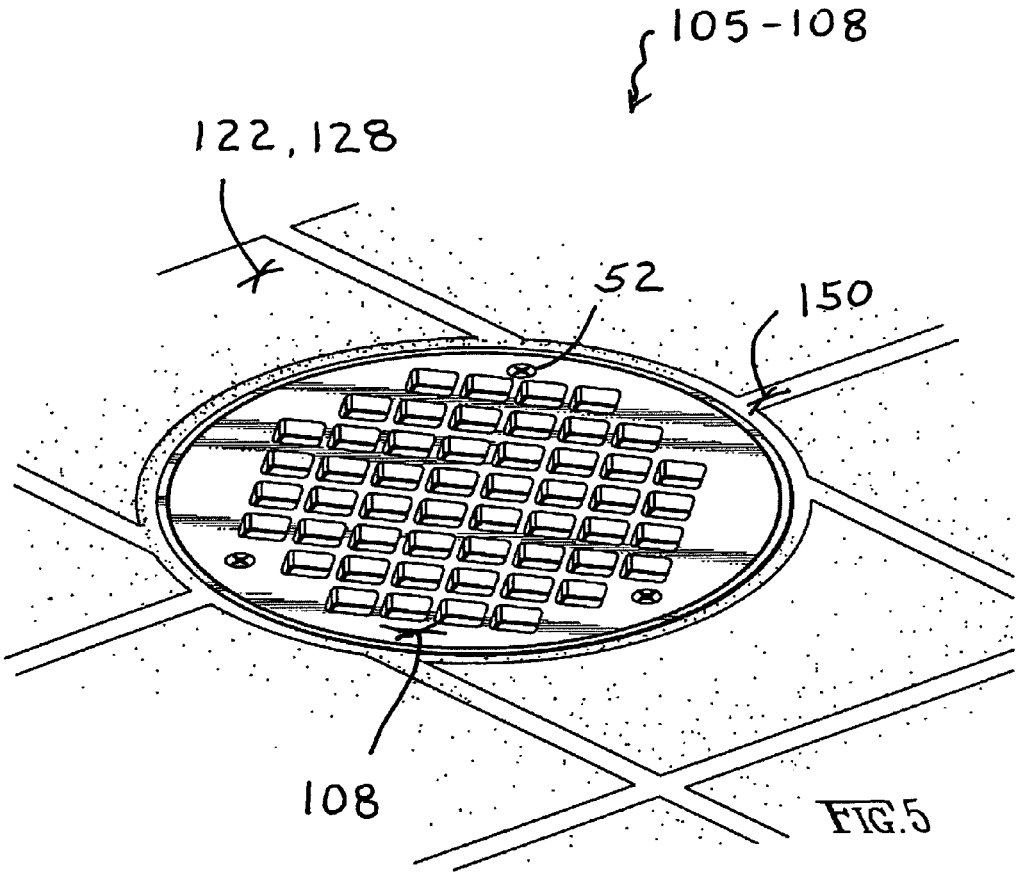
FIG. 5 is a perspective view of a floor drain grate situated flush with a tile floor, and, which has been elevated—as well as leveled—with an adapter in accordance with the invention (hidden from view)
Figure 6:
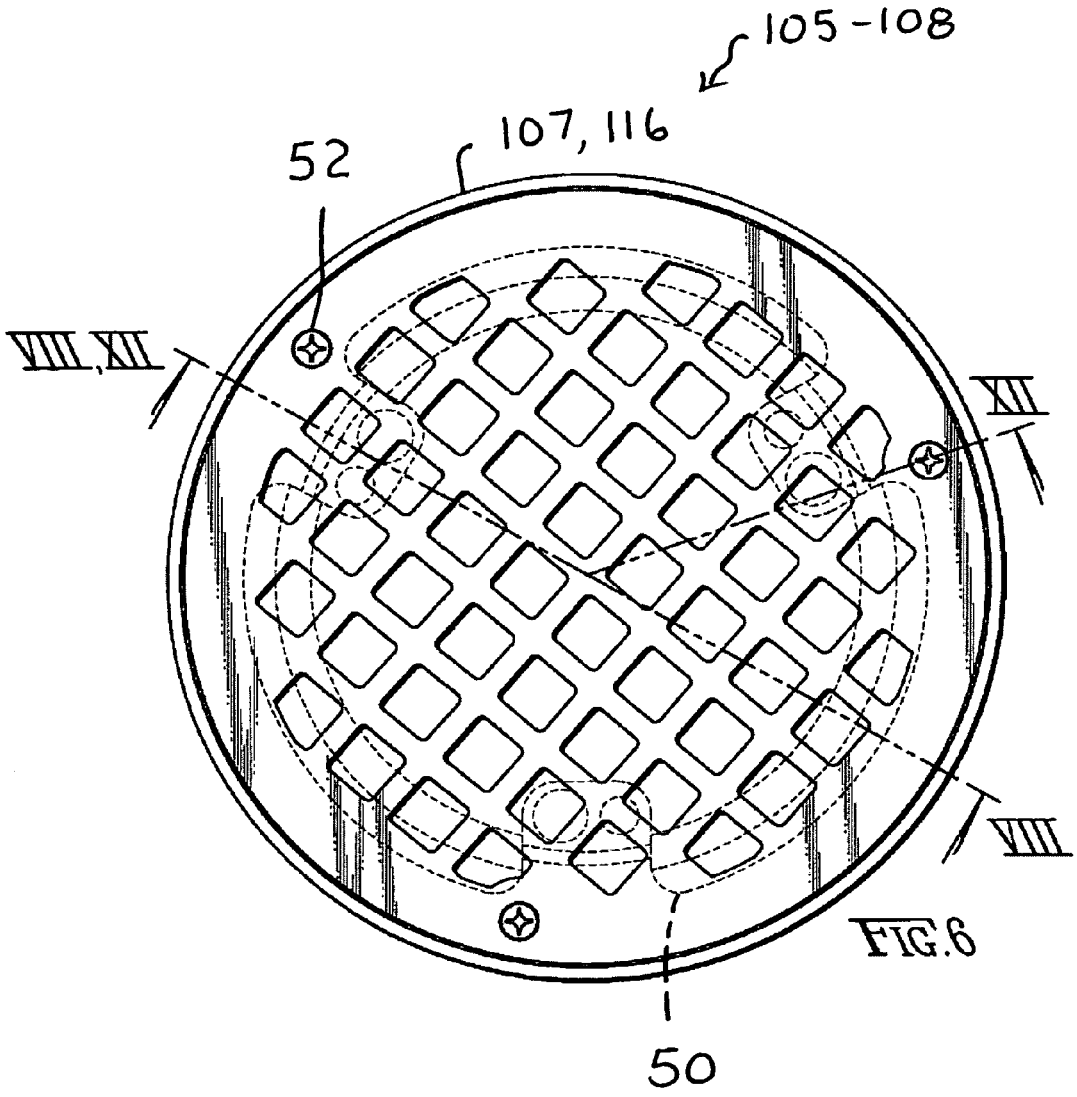
FIG. 6 is an enlarged scale top plan view of FIG. 5, wherein a base ring and a set ring of the adapter in accordance with the invention (ie., which underlie and support the grate) are shown in dashed lines.
Figure 10:
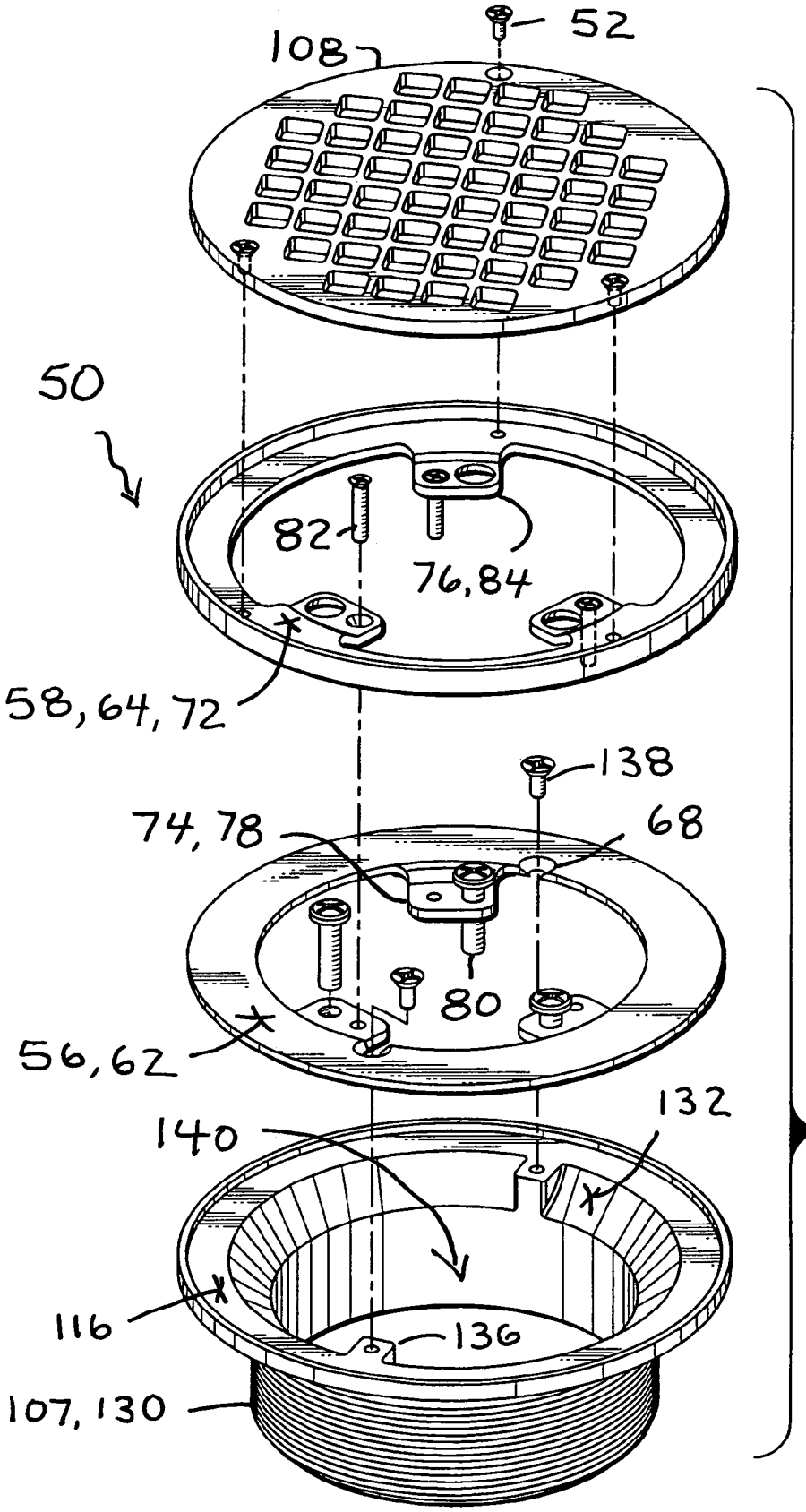
FIG. 10 is an exploded view of the adapter in accordance with the invention (ie., the base ring and set ring thereof), with the grate suspended thereabove while the strainer head is suspended therebelow.

FIGS. 5, 6 and 10 show a floor drain grate 108 situated flush with a tile floor 128, and, which has been elevated—as well as leveled—with a leveling and elevation adapter 50 in accordance with the invention (hidden from view in FIG. 5) for the grate 108 of a floor drain 105-108. The grate 108 is level and even with the tile floor 128.

The adapter 50 in accordance with the invention is particularly advantageous for retrofitting existing floor drain installations 105-108 done in concrete slabs 120 years if not decades ago.

With more particular reference to FIG. 10, the terminal plumbing features of a pre-existing installation of a floor drain 105-108 would typically include the strainer head 107 and the grate 108. The strainer head 107 would be permanently encased in hardened concrete 120 (not shown in FIG. 10, but see FIGS. 8-9 and 11-12). The strainer head 107 is permanently stationary:—excluding, that is, the possibility of jack-hammering it out of the concrete slab 120. But that would no doubt wreck the strainer head 107 too. The strainer head 107 comprises a tubular body 130 that transitions into an upper funnel section 132 that in turn transitions into a grate seat 116. The grate seat 116 is characterized by a horizontal flange portion surrounded by a low rim wall. The grate seat 116 is sized for accepting the seating therein of the grate 108.

Figure 1:
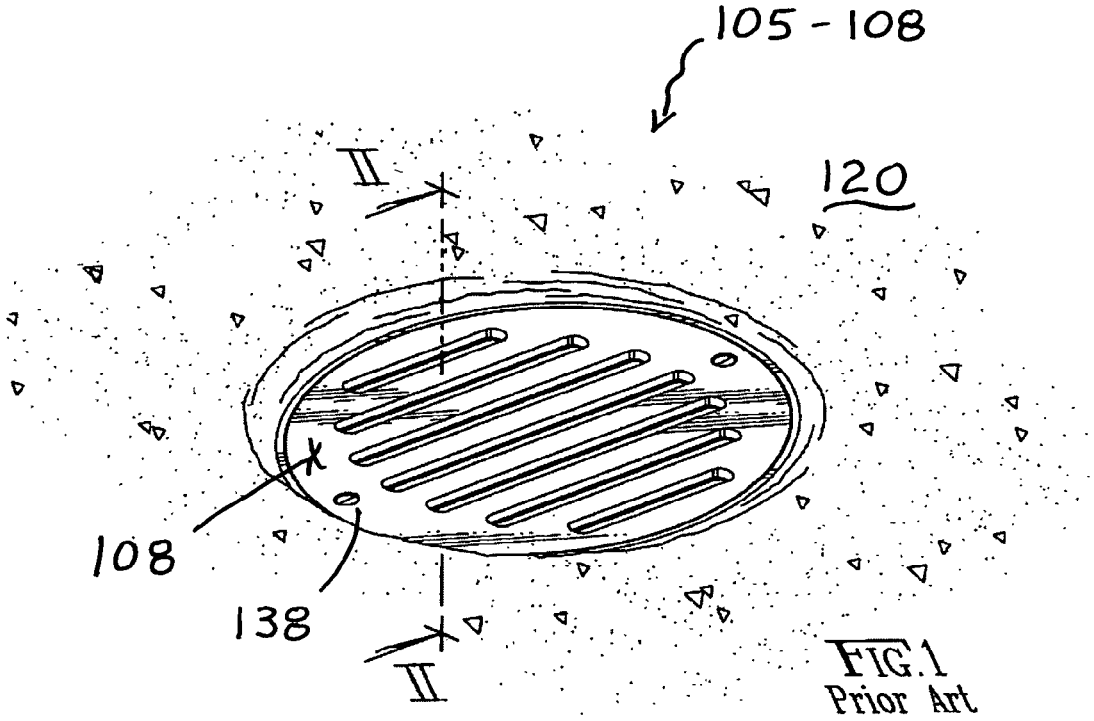
FIG. 1 Prior Art
FIG. 1 is a perspective view of a floor drain grate in accordance with the prior art shown sitting within a shallow depression in a concrete slab and in accordance with the prior art.
Figure 2:
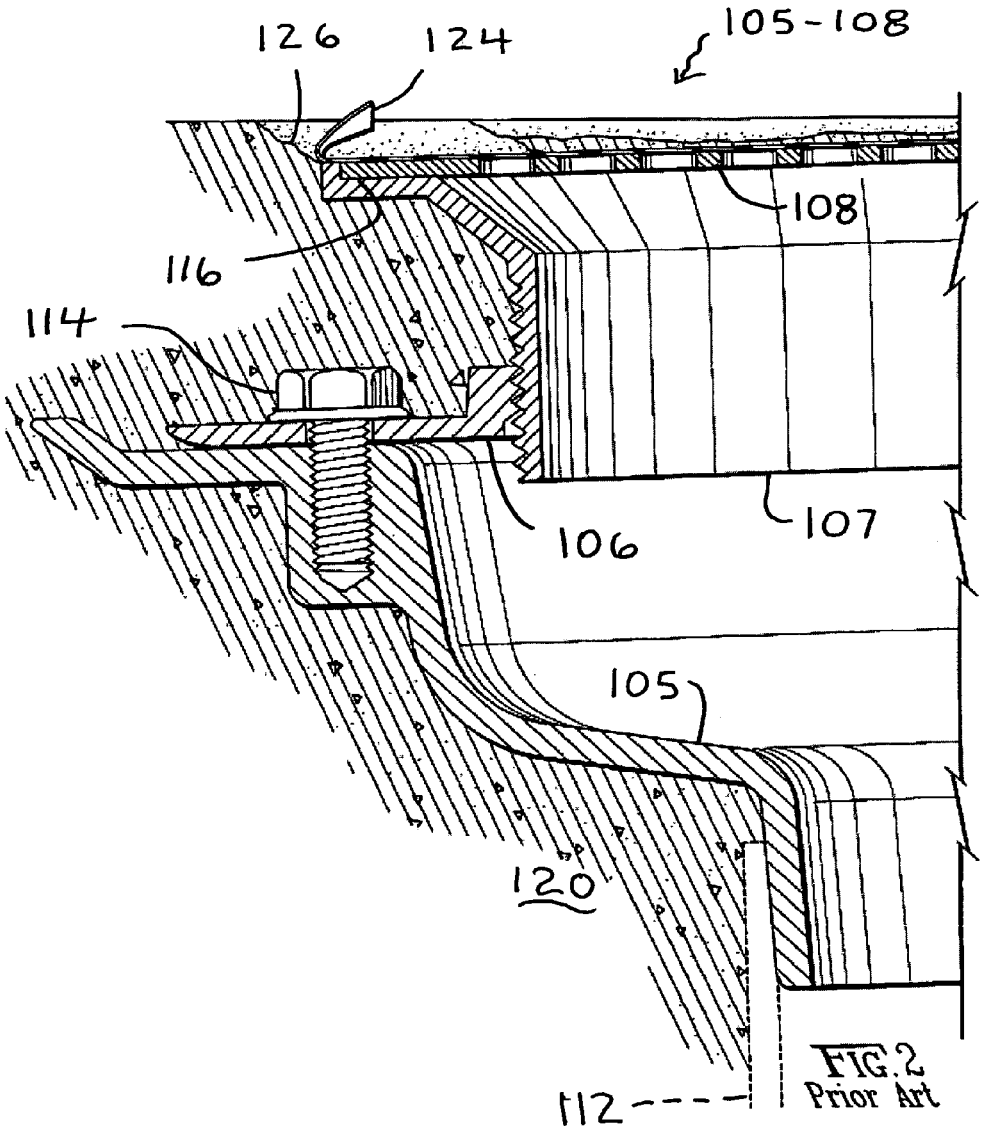
FIG. 2 Prior Art
FIG. 2 is an enlarged scale section view taken on line II-II in FIG. 1.
Figure 3:
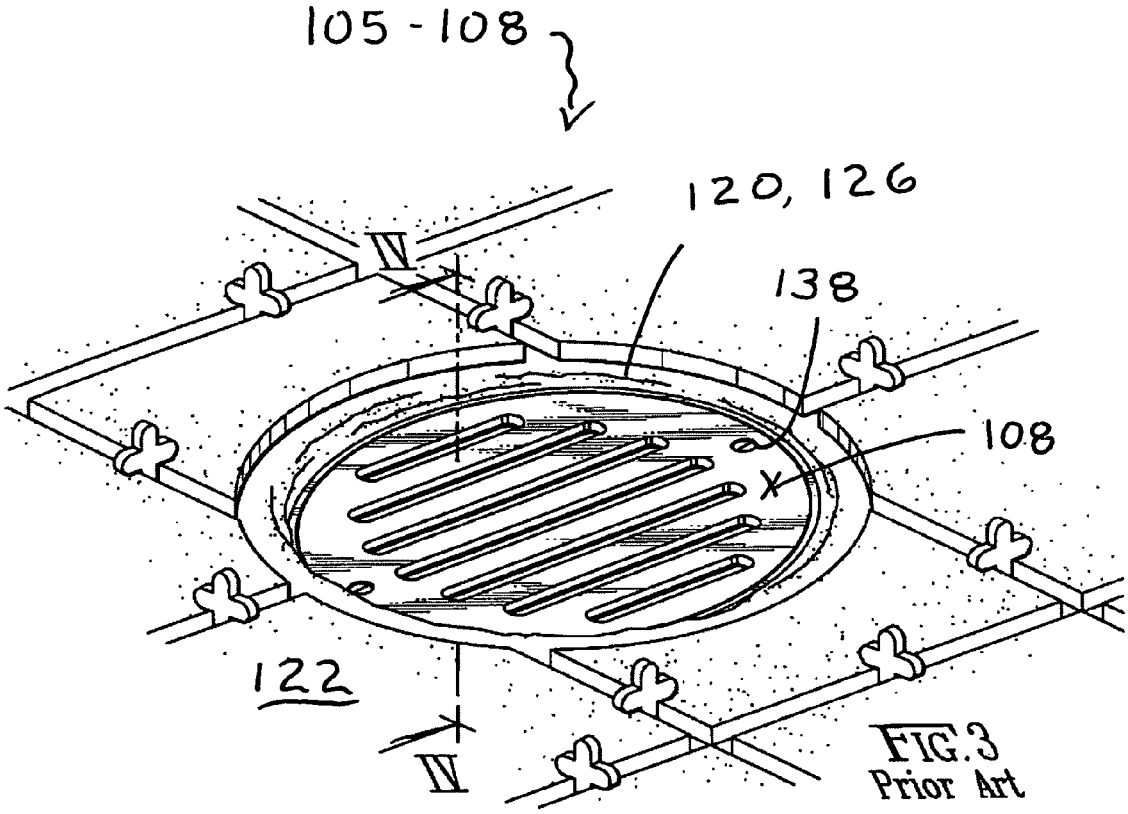
FIG. 3 Prior Art
FIG. 3 is a perspective view comparable to FIG. 1 except showing pieces of tile in accordance with the prior art laid out around the floor drain grate in accordance with the prior art.
Figure 4:
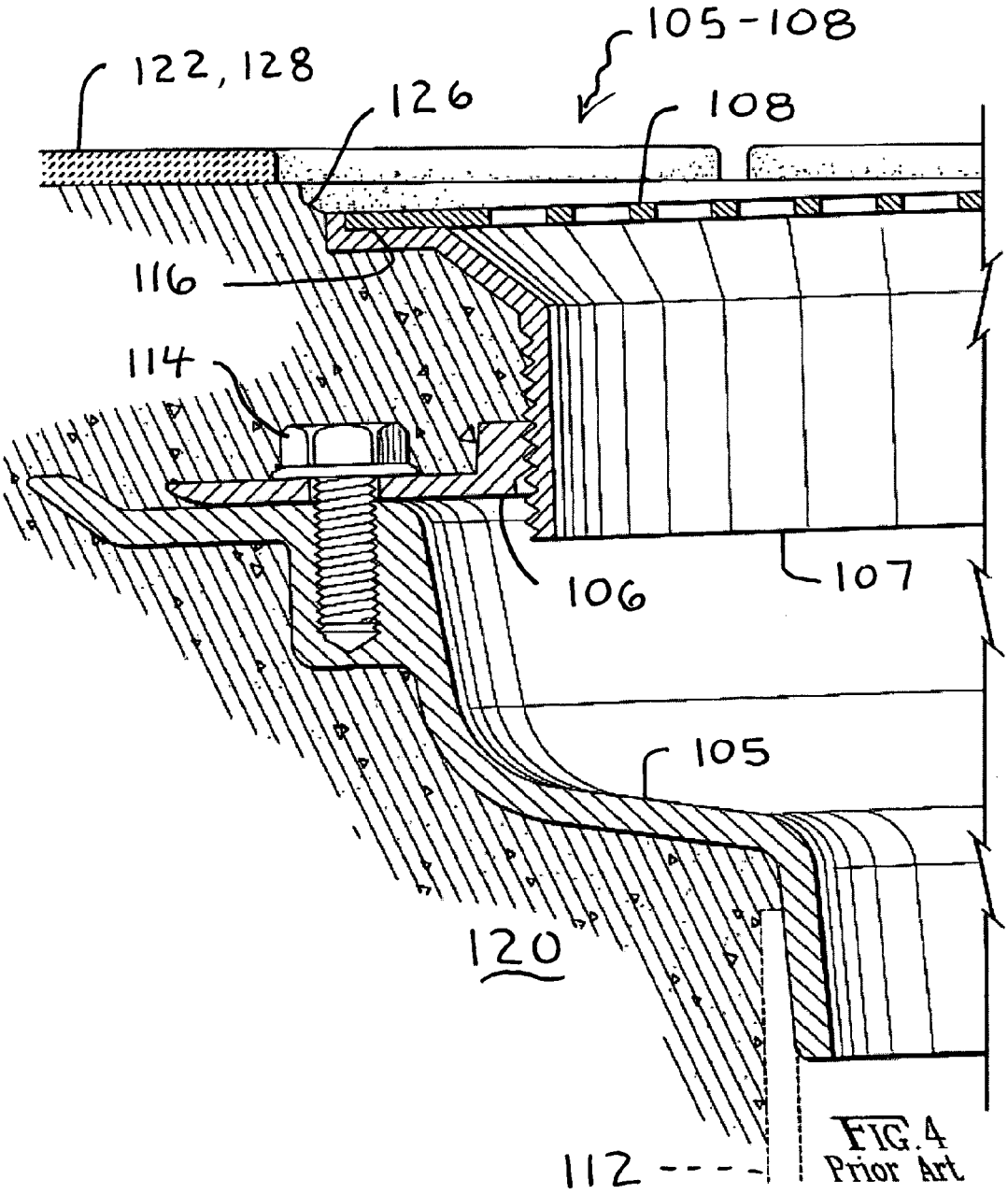
FIG. 4 Prior Art
FIG. 4 is a section view comparable to FIG. 2 except showing the state of things in FIG. 3.
Figure 11:
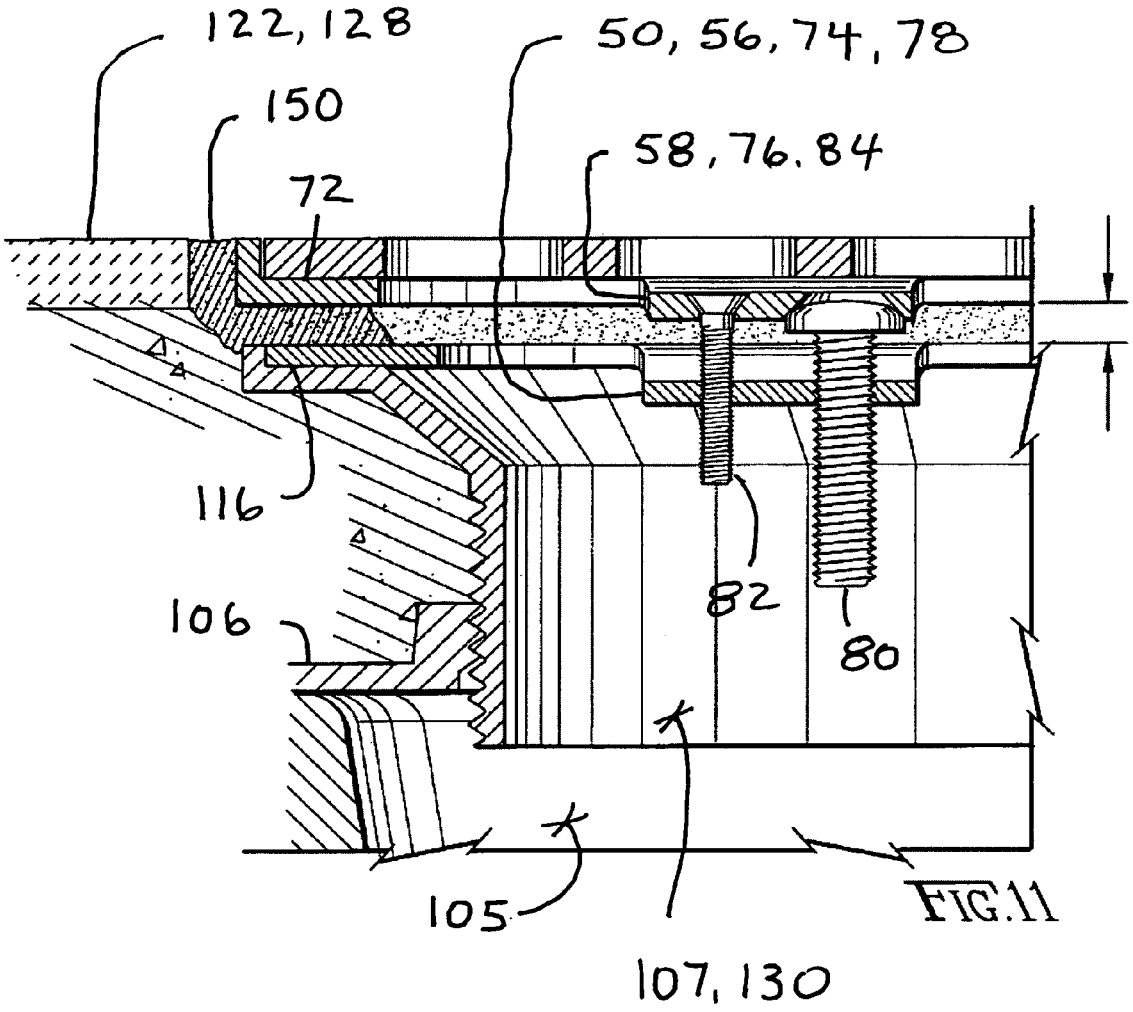
FIG. 11 is a partial section view comparable to FIG. 9 except showing a different installation where the adapter in accordance with the invention had to be adjusted to a greater degree to give the grate in this FIG. 11 a relatively higher elevation relative to the grate in FIG. 9.

The funnel section 132 has two (or might typically have three) bosses 136 extending out of the funnel sidewall thereof which are provided with threaded holes. The grate 108 is typically secured in the seat 116 of the strainer head 107 by assembly screws 138 (see, ie. FIGS. 1 and 3) that tighten in these threaded bosses 136 of the strainer head 107 (FIG. 11). The original stock grate 108 shown in FIGS. 1 and 3 only needed two such assembly screws 138, but whether (as a general consideration) grates and strainer heads utilize two or three or even more assembly screws is entirely a manufacturer dependent factor.

In FIGS. 5 through 12, the stock assembly screws 138 are re-used and referred to hereinafter as the primary assembly screws 138. The strainer head 107's grate seat 116 is re-purposed as well and is likewise referred to hereinafter as the primary grate seat 116.

To turn to the tubular body of the strainer head 107, it defines the central cylindrical lumen 140 that is the drain hole for the strainer head 107.

In FIG. 11, the grate 108 shown in this view is actually a replacement grate 108. The original stock grate 108 shown in FIGS. 1 and 3 accepted only two assembly screws 138 that are angularly spaced 180° apart. This original grate 108 was replaced by this replacement grate 108, which accepts three assembly screws 52 that are angularly spaced 120° apart. Either way, the grate 108 is a cylindrical disk of material—typically brass, bronze, stainless or hard plastic—and is ventilated with a grillwork of openings. The assembly screws 52 which hold the grate 108 to the adapter 50 in accordance with the invention are referenced hereinafter as the secondary assembly screws 52. This is in contrast to the primary assembly screws 138, which hold the adapter 50 to the primary grate seat 116 formed in the strainer head 107 as more particularly described below.

The adapter 50 in accordance with the invention comprises a base ring 56 and an overlying set ring 58. Each ring 56 and 58 has an annular outer ring portion 62 and 64 respectively extending radially between an outer edge and an inner edge. The base ring 56's annular outer ring 62 portion is preferably flat, and for the purpose of being relatively thin and thus not adding much to any elevation increase. The base ring 56's annular outer ring portion 62 is sized to be seated within the primary seat of the strainer head 107. The annular outer ring portion 62 of the base ring 56 is provided with a plurality of holes 68 for accepting the primary assembly screws 138. Thus the primary assembly screws 138 secure the base ring 56 in the primary seat 116 of the strainer head 107, whereby the base ring 56 will be immobilized stationary with the stationary strainer head 107.

In contrast, the set ring 58's annular outer ring portion 64 has a flat undersurface but, with regards to its upper surface, the upper surface thereof is formed in the configuration of a grate seat 72. That is, the upper surface of the set ring 58's annular outer ring portion 64 has a horizontal flat run surrounded by a low rim wall. This grate seat 72 of the set ring 58 is referenced hereinafter as the secondary seat 72, or, secondary grate seat 72.

Figure 8:
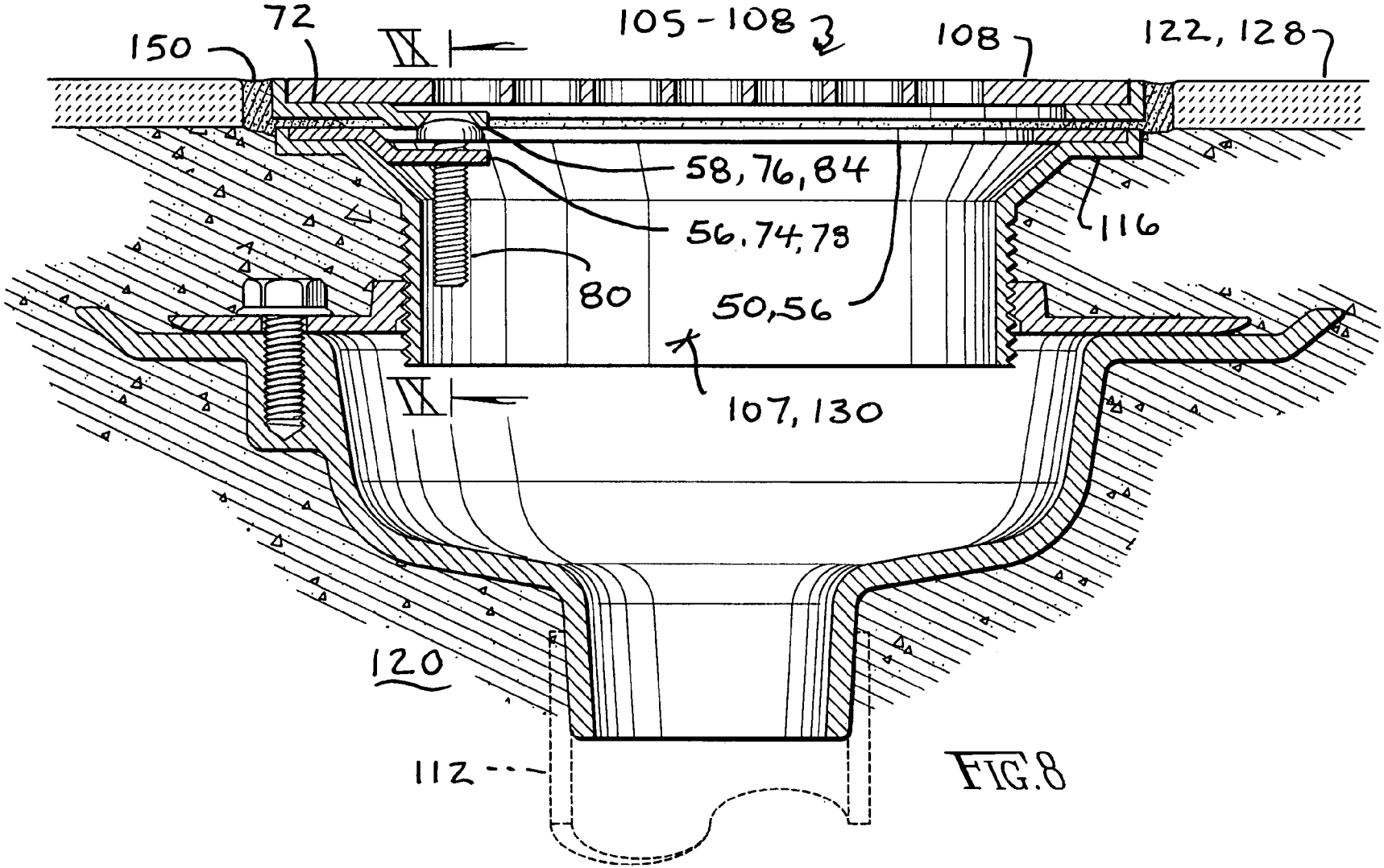
FIG. 8 is an enlarged scale partial section view taken on line VIII-VIII in FIG. 6.
Figure 9:
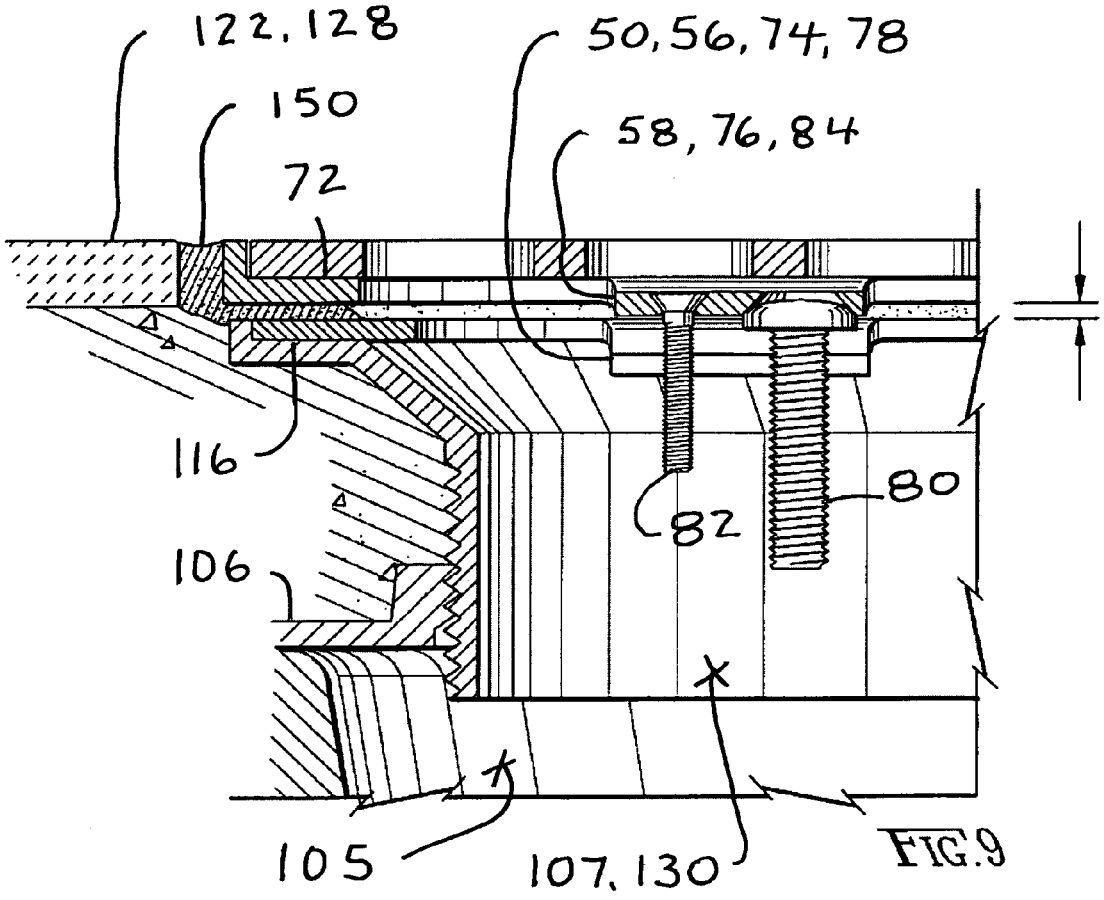
FIG. 9 is an enlarged scale partial sectional view taken in the direction of arrows IX-IX in FIG. 8.

The flat undersurface of the set ring 58's annular outer ring portion allows the set ring 58 to be collapsed flat and flush on top of the base ring 56 and as just about as shown in FIGS. 8 and 9. Albeit, there is a crack of a vertical gap between the base ring 56 and set ring 58 in FIGS. 8 and 9. However, as FIGS. 11 and 12 will later show, that vertical gap is adjustable and can be increased greatly.

Returning to FIG. 10, each of the base ring 56 and the set ring 58 have a plurality of tabs 74 and 76 respectively extending radially inward from the respective inner edge of the respective annular outer ring portion 62 or 64 thereof. The preferred number of tabs 62 (or 64) for the adapter 50 hereof is three, however, this is without limitation.

Thus, the base ring 56 is provided with three such inboard tabs 74 angularly spaced apart by 120°. As better shown by FIG. 8, each tab 74 of the base ring 56 has a funnel-shaped inclined portion leading down and inwards to a flat step portion 78. Indeed, the funnel-shaped inclined portion of the base ring 56 is contoured to rest on and abut the funnel-shaped portion 132 of the strainer head 107. The step portion 78 of the tab 74 of the base ring 56 is contained in a (generally) horizontal plane parallel to the plane containing the annular outer ring portion 62 of the base ring 56.

Returning to FIG. 10, each step portion 78 of the base ring 56 is provided with two tapped holes. One tapped hole is sized for accepting the threaded shank of a jack screw 80. The other tapped hole is sized for accepting the threaded shank of a locking screw 82. Indeed, FIG. 10 shows that there are three such jack screws 80 and three such locking screws 82, one of each for each of the three tabs 74 and 76 respectively of both the base ring 56 and set ring 58.

Preferably the jack screws 80 are pan-head or truss-head style machine screws. That is, each jack screw 80 comprises a threaded shank extending between a tip end and a head end. Preferably the head end is broadened and/or enlarged in a pan-head style or truss-head style. FIG. 10 shows that the jack screws 80 thread into the tabs 74 in the base ring 56, and that the broadened-heads thereof underlie the respective tabs 76 in the set ring 58. FIGS. 8 and 9 show better that the head of the jack screw 80 abuts against and provides upward pressure against the overlying tab 76 of the set ring 58.

Returning again to FIG. 10, the set ring 58 is likewise provided with three such inboard tabs 76 that are angularly spaced apart by 120°. As better shown by FIG. 8, each tab 76 of the set ring 58 has a funnel-shaped inclined portion leading down and inwards to a flat step portion 84. Indeed, the funnel-shaped inclined portion of the set ring 58 is contoured to rest on and abut the funnel-shaped portion of the base ring 56:—if the set ring 58 were collapsed down that far (which it is not in FIG. 8). The step portion 84 of the tab 76 of the set ring 58 is contained in a (generally) horizontal plane parallel to the plane containing the annular outer ring portion 64 of the set ring 58. The plane containing the step portion 84 of the tab 76 of the set ring 58 lies below the plane containing the annular outer ring portion 64 of the set ring 58 by a measure referred to hereinafter as an offset. More particularly, this measure is referred to as the offset characteristic of the set ring 58's tabs 76.

Correspondingly, the plane containing the step portion 78 of the tab 74 of the base ring 56 lies below the plane containing the annular outer ring portion 62 of the base ring 56 by a measure also referred to hereinafter as offset. More particularly, this measure is referred to as the offset characteristic of the base ring 56's tabs 74.

It is a design preference that the offset characteristic of base ring 56's tabs 74 is relatively deeper than that for the offset characteristic of the set ring 58's tabs 76, whereby the offset characteristic of set ring 58's tabs 76 is relatively shallower. That way, when the set ring 58 is collapsed flush and flat on top of the base ring 56, there is still some airspace between the step portions 78 of the base ring 56's tabs 74 and the step portions 84 of the set ring 58's tabs 76. That airspace is utilized for providing vertical clearance for the broadened, enlarged head of the jack screw 80, and as approximately shown in FIGS. 8 and 9. Albeit, in FIGS. 8 and 9, the set ring 58 is elevated slightly and is not truly flush flat against the base ring 56.

Returning once more to FIG. 10, each step portion 84 of the set ring 58 is provided with two apertures. One aperture is sized for several purposes with respect to the jack screw 80. As FIG. 8 shows, the aperture is conically contoured on the underside thereof to keep the head of the jack screw 80 self-centered therein. But also, the diameter of this aperture is sized to be too small to let the head of the jack screw 80 pass through. Thus the head of the jack screw 80 bears upward in the conic portion of this aperture to provide upward or elevating pressure to the set ring 58. Back in FIG. 10, this aperture in the set ring 58 tab 76 for the jack screw 80 is also sized, while being too small to let the head of the jack screw 80 pass, it is otherwise large enough to allow a driving tool pass therethrough (driving tool not shown).

In the drawings, the preferred driving tool would be a Phillips screwdriver or the like, however, this preference is without any limitation and any driving tool will suffice so long as the driving-formations in the screw head is in the matching style.

FIGS. 9 and 10 show better that the other aperture in the tab 76 of the set ring 58 is sized for allowing the tip end and shank of the locking screw pass 82 through and twist into the tapped hole therefor in the tab 74 of the base ring 56. Preferably the locking screw 82 has an enlarged head that bears against the top of the tab 76 of the set ring 58 and therefor produces a clamping pressure between the set ring 58 and base ring 56. The design preference for the head style of the locking screw 82 includes without limitation a counter-sink head style machine screw.

Figure 7:
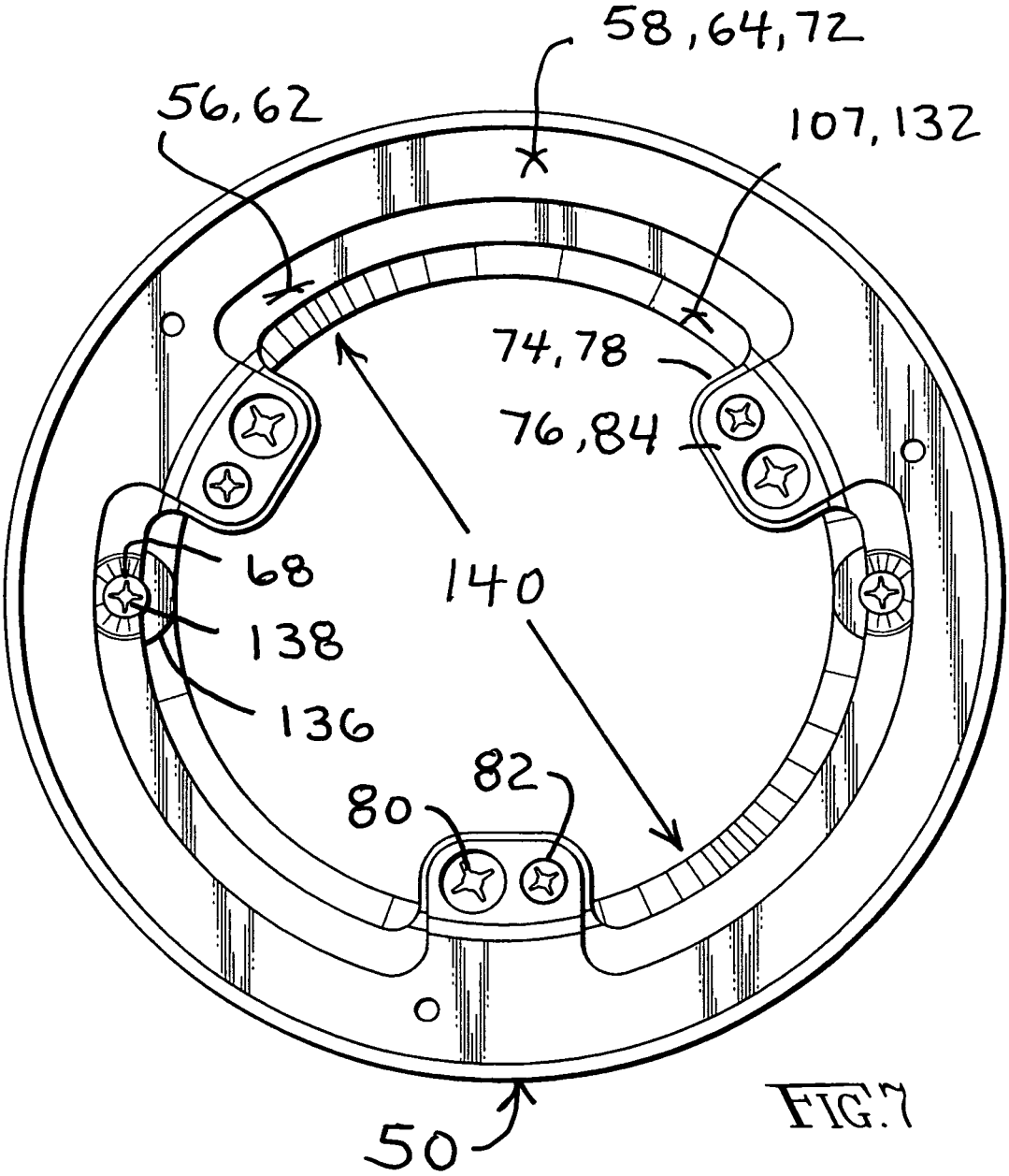
FIG. 7 is a top plan view of a leveling and elevation adapter in accordance with the invention for the grate of a floor drain (grate not shown), wherein the funnel section of the strainer head appears in the view, but the funnel section for the cast iron body has been removed from the view.

FIGS. 7 and 8 show better that the relative inward extension of the tabs 74 and 76 respectively of the base ring 56 and set ring 58 allow the holes and apertures for the jack and locking screws 80 and 82 to be placed inwardly such that the following is possible. That is, the shanks and tip ends of the jack and locking screws 80 and 82 can occupy space inside of and travel in the central lumen 140 of the strainer head 107 that is the drain hole therefor.

That way, there is non-interference between the screws 80 or 82 and strainer head 107, and clearance is gained for the utilization of relatively long jack screws 80 and/or locking screws 82.

With renewed attention to FIGS. 8 and 9, they show the completion of the installation of the adapter 50 in accordance with the invention. The base ring 56 has been secured to the primary seat 116 of the strainer head 107 by the primary assembly screws 138 (not shown in these views). The set ring 58 was assembled above the base ring 56. The jack screws 80 were adjusted to elevate the set ring 58 slightly and in order to become flush with the plane of the tile pieces 122 (before they were grouted). The locking screws 82 were tightened to hold the set ring 58 at the adjusted elevation.

After that, the third group of tradesmen—the tilers—would come through and finish the grouting around the tile pieces 122. It is an aspect of the invention that the grout 150 is allowed to squeeze in through the vertical gap between the base ring 56 and set ring 58 of the adapter 50 in accordance with the invention. It has been discovered that there are a number of advantages for doing so. One is that, the grout 150 provides additional undergirding support to the set ring 58. Additionally, the grout 150 surely laps over portions of the base ring 56's outer annular ring portion 62 and makes the base ring 56 more or less permanently cemented in hardened grout 150 with the strainer head 107.

Moreover, it has been the experience of the inventor hereof that, the frictional and/or cementitious grip of the hardened grout 150 on the set ring 58 also tends to bind the set ring 58 as a monolithic unit with the base ring 56 and strainer head 107.

Therefore, not only does the adapter 50 in accordance with the invention provide leveling and elevation adjustment for the grate 108 of the floor drain 105-108, it also accepts grout 150 such that the adapter 50 behaves as if were a solid monolithic unit with the strainer head 107.

In other words, it is a given that the strainer head 107, when encased inside hardened concrete 120, is a solid fixture. Correspondingly, when the base ring 56 and set ring 58 of the adapter 50 in accordance with the invention are assembled into the strainer head 107 and then encased in hardened grout 150, the base ring 56 and set ring 58 are as much as a solid fixture in conjunction with the strainer head 107 as the strainer head 107 is on its own.

Figure 12:
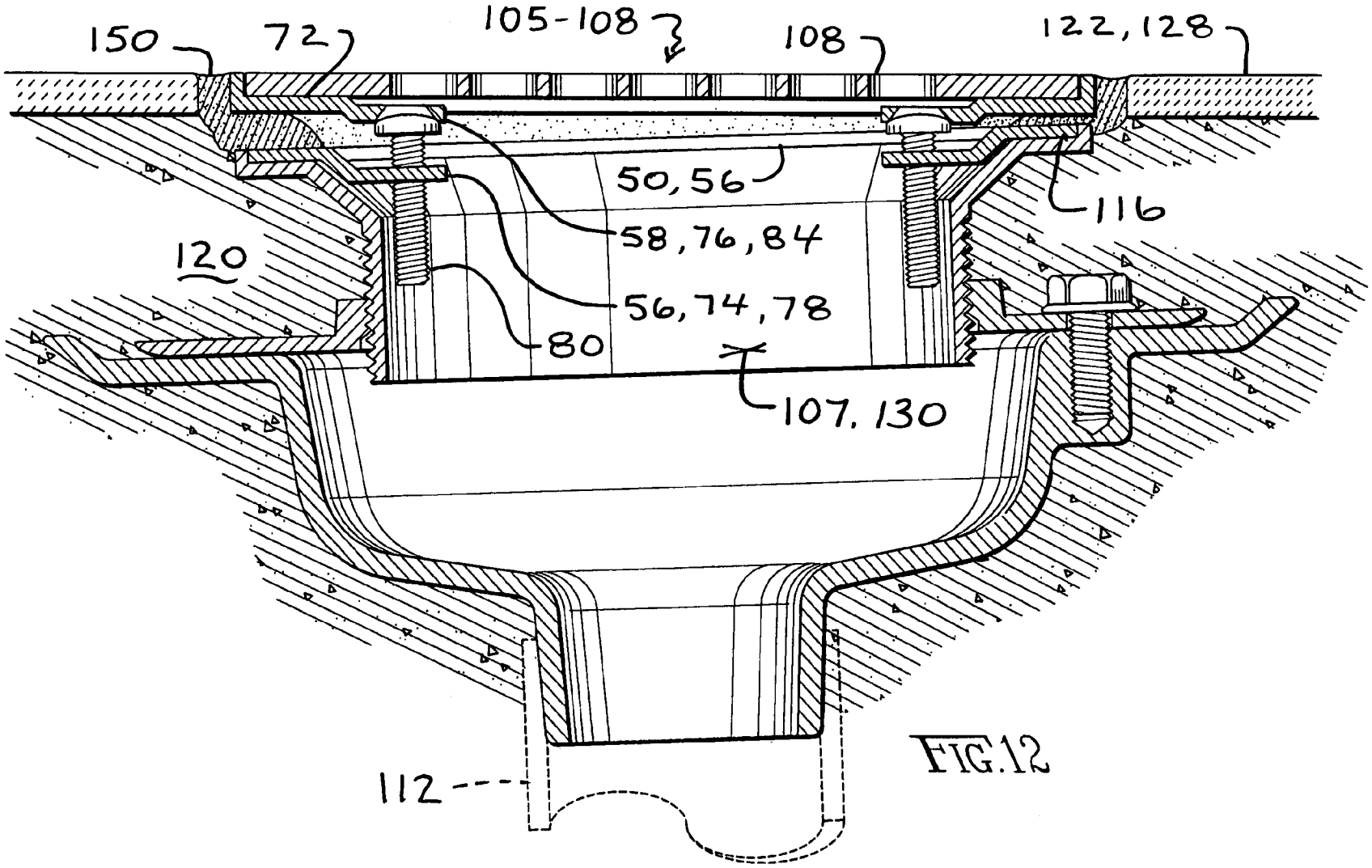
FIG. 12 is an enlarged scale partial section view which is comparable to FIG. 8 and which corresponds to a section view taken along an offset line such as line XII-XII in FIG. 6, except however, this section view is for the different drain installation of FIG. 11.

FIGS. 11 and 12 show a different drain installation 105-108 from that shown in FIGS. 8 and 9. FIGS. 11 and 12 show a far more tilted drain installation 105-108, where the riser pipe 112 is tilted further from vertical than in FIGS. 8 and 9, and the primary grate seat 116 of the strainer head 107 is further below the grade of the tile pieces 122. Nevertheless, the adapter 50 in accordance with the invention allows ready adjustment for elevation and levelness to provide the secondary grate seat 72 to be flush at the grade of the tile floor 128.

Once again, grout 150 is urged in the gap between the base ring 56 and set ring 58 in order to promote the solidification of the base ring 56 and set ring 58 as a monolithic unit with the strainer head 107.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A leveling and elevation adapter for interposition between a removable floor drain grate and a strainer head of a floor drain for a surrounding floor surface defining a local grade therefor, which strainer head is immobilized and encased in a hardened concrete slab, said strainer head comprising a tubular body that has an upper end terminating in a primary grate-seat that is characterized by a horizontal flange portion surrounded by a low rim wall, said tubular body defining a central lumen for the strainer head, and, said primary grate-seat sits in a shallow depression below the grade of the surrounding floor surface; said floor drain comprising a funnel-formed drain body, a plate-formed flashing collar disposed covering the funnel-formed drain body, a plurality of flashing-collar bolts to fasten the flashing collar and drain body together, said strainer head comprising a tubular lower section formed with external thread and said flashing collar having a central aperture formed with internal thread for receiving the external thread of the lower tubular section of the strainer head; said adapter comprising:

a base ring having an annular outer ring portion sized to be seated in the primary grate-seat of the strainer head;

a set ring having an annular outer ring portion that has an upper surface defining a second grate-seat characterized by a horizontal flat run surrounded by a low rim wall and sized to accept the seating of the grate therein;

a plurality of horizontally spaced apart jack screws for vertically spacing apart the base ring and set ring by a gap, wherein the jack screws are adjustable to allow a user to change the height of the gap and even the secondary grate-seat with the grade of the surrounding floor; and a construction cement vertically bridging the gap between the base ring and set ring and at least marginally over the concrete slab which when said construction cement hardens, said construction cement provides additional undergirding support to the set ring;

wherein the base ring is fastened to the primary grate-seat of the strainer head by a plurality of primary assembly screws through the annular outer ring portion of the base ring and into the horizontal flange portion of the strainer head; and wherein the grate is fastened to the secondary grate-seat of the set ring by a plurality of secondary assembly screws through the grate and into the annular outer ring portion of the set ring.

2. The adapter of claim 1 wherein:

the construction cement solidifies the base ring as a monolithic unit with the strainer head.

3. The adapter of claim 1 wherein:

the construction cement comprises grout.

4. The adapter of claim 1 wherein:

the grade of the surrounding floor comprises the grade of a tile floor.

5. The adapter of claim 1 wherein:

while the jack screws are adjustable to allow a user to change the height of the gap and even the secondary grate-seat with the grade of the surrounding floor, the jack screws do not lock the set ring relative to the base ring to fix the height of the gap.

6. The adapter of claim 1 wherein:

the construction cement solidifies the set ring and the base ring as a monolithic unit with the strainer head.

7. The adapter of claim 1 wherein:

the annular outer ring portion of the base ring comprises an inner edge and an angularly distributed plurality of inboard tabs extending inwards from the inner edge, said tabs being formed with threaded sockets for the jack screws to screw in;

each jack screw comprises a relatively long shank extending between a head and a tip end, wherein the heads are adapted to abut and carry the set ring;

said base ring's tabs extend inwards sufficiently such that the threaded sockets can be disposed relative the strainer head such that the shanks and tip ends of the jack screws can occupy space inside of and travel in the central lumen of the strainer head.

8. The adapter of claim 7 wherein:

the annular outer ring portion of the set ring comprises an inner edge and an angularly distributed plurality of inboard tabs extending inwards from the set ring's inner edge; and wherein said set ring's inboard tabs are located above the tabs belonging to the base ring, whereby the heads of the jack screws are adapted to abut the tabs belonging to the set ring and carry the set ring thereby.

9. The adapter of claim 7 wherein:

the annular outer ring portion of the set ring sized to sit flat and flush on top of the annular outer portion of the base ring;

the tabs of the base ring have step portions that are contained in a generally horizontal plane generally parallel to a plane containing the annular outer ring portion of the base ring;

the plane containing the step portions of the tabs of the base ring lie below the plane containing the annular outer ring portion of the base ring by a measure defined as an offset characteristic of the base ring's tabs;

the step portions of the base ring are formed with threaded sockets for the jack screws to screw in, and, the jack screws are provided with heads adapted to abut and carry the set ring on at angularly disposed jack-screw head-bearing locations on the underside of the set ring;

wherein the offset characteristic of base ring's tabs is sized to provide an airspace with the angularly disposed jack-screw head-bearing locations on the underside of the set ring when the annular outer ring portion of the set ring is collapsed flush and flat on top of the annular outer ring portion of the base ring, wherein the airspace is utilized for providing vertical clearance for the broadened, enlarged heads of the jack screws.

10. The adapter of claim 1 wherein:

the annular outer ring portion of the base ring is characterized by an axial, generally vertical thickness;

the grate is characterized by an axial, generally vertical thickness; and the axial, generally vertical thickness of the grate is equal to or greater than the axial, generally vertical thickness of the annular outer ring portion of the base ring.

11. The adapter of claim 10 wherein:

the horizontal flat run of the annular outer ring portion of the set ring is characterized by an axial, generally vertical thickness; and the axial, generally vertical thickness of the grate is equal to or greater than the axial, generally vertical thickness of the horizontal flat run of the annular outer ring portion of the set ring.

12. A leveling and elevation adapter for interposition between a removable floor drain grate and a strainer head of a floor drain for a surrounding floor surface defining a local grade therefor, which strainer head is immobilized and encased in a hardened concrete slab, said strainer head comprising a tubular body that has an upper end terminating in a primary grate-seat that is characterized by a horizontal flange portion surrounded by a low rim wall, said tubular body defining a central lumen for the strainer head, and, said primary grate-seat sits in a shallow depression below the grade of the surrounding floor surface; said adapter comprising:

a base ring having an annular outer ring portion sized to be seated in the primary grate-scat of the strainer head;

a set ring having an annular outer ring portion that has an upper surface defining a secondary grate-seat characterized by a horizontal flat run surrounded by a low rim wall and sized to accept the seating of the grate therein; and a plurality of horizontally spaced apart jack screws for vertically spacing apart the base ring and set ring by a gap, wherein the jack screws are adjustable to allow a user to change the height of the gap and even the secondary grate-seat with the grade of the surrounding floor;

wherein the annular outer ring portion of the base ring comprises an inner edge and an angularly distributed plurality of inboard tabs extending inwards from the inner edge, said tabs being formed with threaded sockets for the jack screws to screw in;

wherein each jack screw comprises a relatively long shank extending between a head and a tip end;

wherein the annular outer ring portion of the set ring comprises an inner edge and an angularly distributed plurality of inboard tabs extending inwards from the set ring's inner edge;

wherein said set ring's inboard tabs are located above the tabs belonging to the base ring;

wherein the heads of the jack screws are adapted to abut the tabs belonging to the set ring and carry the set ring thereby; and further comprising a locking screw for each jack screw and paired closely alongside the respective jack screw;

each locking screw comprises a relatively long shank extending between a head and a tip end;

wherein the tabs belonging to the set ring have through journals for the shanks but not the heads of the locking screws to slide therethrough and spin therein; and the tabs belonging to the base ring are formed with threaded sockets for the locking screws;

said locking screws can be tightened from a slack state, which allows the tabs of the set ring to be lifted off the heads of the jack screws as well as leaves the height of the gap unfixed, to a tightened state, which fastens the set ring fixed with the jack screws and the base ring as well as fixes the height of the gap;

whereby with the locking screws slack, turning the jack screws allows changing the height of the gap, after which tightening the locking screws fixes the height of the gap.

13. A leveling and elevation adapter for interposition between a removable floor drain grate and a strainer head of a floor drain for a surrounding floor surface defining a local grade therefor, which strainer head is immobilized and encased in a hardened concrete slab, said strainer head comprising a tubular body that transitions into an upper funnel section that in turn transitions into a primary grate-seat that is characterized by a horizontal flange portion surrounded by a low rim wall, said tubular body defining a central lumen for the strainer head, and, said primary grate-seat sits in a shallow depression below the grade of the surrounding floor surface; said adapter comprising:

a base ring having an annular outer ring portion sized to be seated in the primary grate-seat of the strainer head;

a set ring having an annular outer ring portion that has an upper surface defining a secondary grate-seat characterized by a horizontal flat run surrounded by a low rim wall and sized to accept the seating of the grate therein;

a plurality of horizontally spaced apart jack screws for vertically spacing apart the base ring and set ring by a gap, wherein the jack screws are adjustable to allow a user to change the height of the gap and even the secondary grate-seat with the grade of the surrounding floor;

the annular outer ring portion of the base ring comprises an inner edge and an angularly distributed plurality of inboard tabs extending inwards from the inner edge, said tabs being formed with threaded sockets for the jack screws to screw in;

wherein each tab of the base ring has a funnel-shaped inclined portion leading down and inwards from the inner edge of the annular outer ring portion of the base ring, to a flat step portion; and wherein the funnel-shaped inclined portions of the tabs of the base ring are contoured to rest on and abut the funnel-shaped portion of the strainer head, and thereby said set ring gaining additional undergirding support from the strainer head.

14. The adapter of claim 13 wherein:

each jack screw comprises a relatively long shank extending between a head and a tip end, wherein said heads of the jack screws are adapted to abut and carry the set ring;

said base ring's tab extending inwards sufficiently such that the threaded sockets can be disposed relative the strainer head such that the shanks and tip ends of the jack screws can occupy space inside of and travel in the central lumen of the strainer head.

15. The adapter of claim 14 wherein:

the annular outer ring portion of the set ring sized to sit flat and flush on top of the annular outer portion of the base ring;

the step portions of the tabs of the base ring are contained in a generally horizontal plane generally parallel to a plane containing the annular outer ring portion of the base ring;

the plane containing the step portions of the tabs of the base ring lie below the plane containing the annular outer ring portion of the base ring by a measure defined as an offset characteristic of the base ring's tabs;

the step portions of the tabs of the base ring are formed with the threaded sockets for the jack screws to screw in, and, whereby the tabs and step portions of the base ring are angularly disposed such that the heads of the jack screws abut and carry the set ring at angularly disposed jack-screw head-bearing locations on the underside of the set ring;

wherein the offset characteristic of base ring's tabs is sized to provide an airspace with the angularly disposed jack-screw head-bearing locations on the underside of the set ring when the annular outer ring portion of the set ring is collapsed flush and flat on top of the annular outer ring portion of the base ring, wherein the airspace is utilized for providing vertical clearance for the broadened, enlarged heads of the jack screws.

16. A leveling and elevation adapter for interposition between a removable floor drain grate and a strainer head of a floor drain for a surrounding floor surface defining a local grade therefor, which strainer head is immobilized and encased in a hardened concrete slab, said strainer head comprising a tubular body that transitions into an upper funnel section that in turn transitions into a primary grate-seat that is characterized by a horizontal flange portion surrounded by a low rim wall, said tubular body defining a central lumen for the strainer head, and, said primary grate-seat sits in a shallow depression below the grade of the surrounding floor surface; said adapter comprising:

a base ring having an annular outer ring portion sized to be seated in the primary grate-seat of the strainer head;

a set ring having an annular outer ring portion that has an upper surface defining a secondary grate-seat characterized by a horizontal flat run surrounded by a low rim wall and sized to accept the seating of the grate therein;

a plurality of horizontally spaced apart jack screws for vertically spacing apart the base ring and set ring by a gap, wherein the jack screws are adjustable to allow a user to change the height of the gap and even the secondary grate-seat with the grade of the surrounding floor;

said annular outer ring portion of the base ring comprising an inner edge and an angularly distributed plurality of inboard tabs extending inwards from the inner edge, said tabs being formed with threaded sockets for the jack screws to screw in;

each jack screw comprising a relatively long shank extending between a head and a tip end, wherein said heads of the jack screws are adapted to abut and carry the set ring; and said base ring's tabs being elongated inwards sufficiently such that the threaded sockets can be disposed relative the strainer head such that the shanks and tip ends of the jack screws can occupy space inside of and travel in a projection of the central lumen of the strainer head into the upper funnel section thereof, and thereby avoid grounding out against the upper funnel section.

17. The adapter of claim 16 wherein:

the annular outer ring portion of the set ring sized to sit flat and flush on top of the annular outer portion of the base ring;

each tab of the base ring has a funnel-shaped inclined portion leading down and inwards from the inner edge of the annular outer ring portion of the base ring, to a flat step portion;

the step portions of the tabs of the base ring are contained in a generally horizontal plane generally parallel to a plane containing the annular outer ring portion of the base ring;

the plane containing the step portions of the tabs of the base ring lie below the plane containing the annular outer ring portion of the base ring by a measure defined as an offset characteristic of the base ring's tabs;

the step portions of the tabs of the base ring are formed with the threaded sockets for the jack screws to screw in, and, whereby the tabs and step portions of the base ring are angularly disposed such that the heads of the jack screws abut and carry the set ring at angularly disposed jack-screw head-bearing locations on the underside of the set ring;

wherein the offset characteristic of base ring's tabs is sized to provide an airspace with the angularly disposed jack-screw head-bearing locations on the underside of the set ring when the annular outer ring portion of the set ring is collapsed flush and flat on top of the annular outer ring portion of the base ring, wherein the airspace is utilized for providing vertical clearance for the broadened, enlarged heads of the jack screws.

18. A leveling and elevation adapter according to claim 16 for a floor drain comprising a funnel-formed drain body, a plate-formed flashing collar disposed covering the funnel-formed drain body, a plurality of flashing-collar bolts to fasten the flashing collar and drain body together, said strainer head comprising a tubular lower section formed with external thread and said flashing collar having a central aperture formed with internal thread for receiving the external thread of the lower tubular section of the strainer head; wherein:

the base ring is fastened to the primary grate-seat of the strainer head by a plurality of primary assembly screws through the annular outer ring portion of the base ring and into the horizontal flange portion of the strainer head; and the grate is fastened to the secondary grate-seat of the set ring by a plurality of secondary assembly screws through the grate and into the annular outer ring portion of the set ring.

19. The adapter of claim 16 wherein:

the annular outer ring portion of the set ring comprises an inner edge and an angularly distributed plurality of inboard tabs extending inwards from the set ring's inner edge; and wherein said set ring's inboard tabs are located above the tabs belonging to the base ring, whereby the heads of the jack screws are adapted to abut the tabs belonging to the set ring and carry the set ring thereby;

the tabs belonging to the set ring are provided with access holes directly above the heads of the respective jack screw in order to allow a screw driver to reach through and turn the respective jack screw; and said access holes being smaller diameter than the heads of the jack screws and hence the heads of the jack screws do not pass through said access holes and instead bear against a solid bottom periphery of the set ring that surrounds each of the access holes.

* * * * *